United States Patent [19]

Tinkham

[11] 4,015,555

[45] Apr. 5, 1977

[54] AIR BOAT

[76] Inventor: Sherman L. Tinkham, 1406 E. Lotus Path, Clearwater, Fla. 33516

[22] Filed: Nov. 29, 1974

[21] Appl. No.: 528,262

Related U.S. Application Data

[63] Continuation of Ser. No. 347,865, April 4, 1973, abandoned.

[52] U.S. Cl. ..... 115/1 C

[51] Int. Cl.[2] ..... B60F 3/00

[58] Field of Search ..... 115/.5 R, .5 B, 1 R, 115/1 C, 3, 35; 180/1 R, 3 R; 244/54, 60

[56] References Cited

UNITED STATES PATENTS

| | | | |
|---|---|---|---|
| 1,048,337 | 12/1912 | Offenburger | 180/3 R |
| 1,220,278 | 3/1917 | Schurr | 180/3 R |
| 1,443,368 | 1/1923 | Lamblin | 115/.5 R |
| 1,492,378 | 4/1924 | Krysak | 180/3 R |
| 1,542,165 | 6/1925 | Oechsle | 115/.5 R |
| 1,834,068 | 12/1931 | Merickle | 115/1 C |
| 1,917,574 | 7/1933 | Booth | 244/54 |
| 2,855,885 | 10/1958 | Thomas | 115/1 R |
| 2,948,250 | 8/1960 | Peterson | 115/.5 R |
| 3,176,647 | 4/1965 | Grengs et al. | 115/1 R |
| 3,698,163 | 10/1972 | Kelpin | 115/3 R |

FOREIGN PATENTS OR APPLICATIONS

| | | | |
|---|---|---|---|
| 669,315 | 11/1929 | France | 244/54 |

*Primary Examiner*—Trygve M. Blix
*Assistant Examiner*—Stuart M. Goldstein
*Attorney, Agent, or Firm*—Robert F. Ruemeli

[57] ABSTRACT

An air boat has a power unit including a typical automotive engine and a pylon mounted on the engine clutch housing and carrying an aircraft type propeller at its upper end. Belts or a chain housed within the pylon drivingly connect the motor and propeller. The motor and pylon are preferably mounted on a base which is removably mounted on the air boat hull. Preferably, the base also carries a cooling system radiator, fuel tank, and typical engine accessories so that the entire power unit may be installed in and removed from the air boat as an integral unit, thus facilitating servicing of the power unit at a convenient location out of the boat hull with the power unit fully assembled and ready to run when it is returned to the air boat.

32 Claims, 4 Drawing Figures

FIG. 1
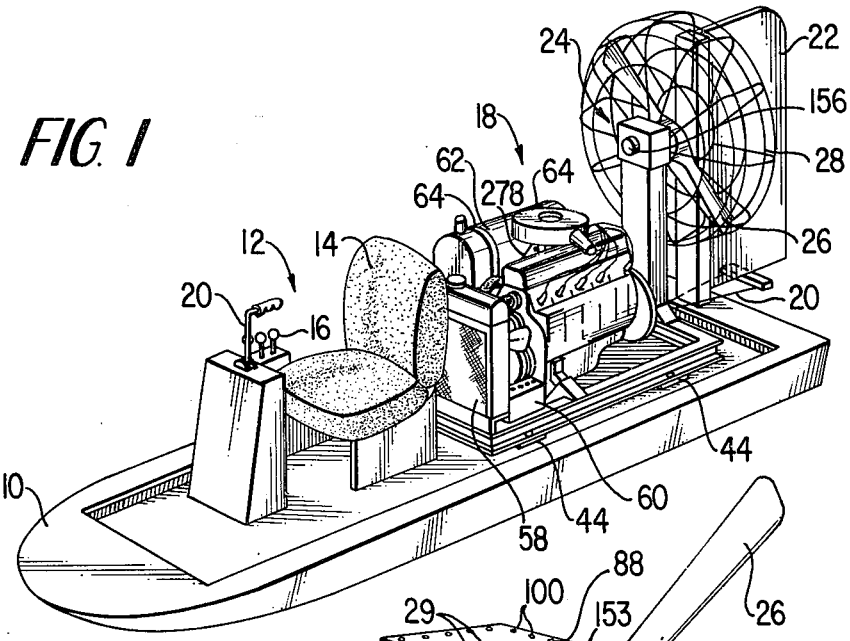
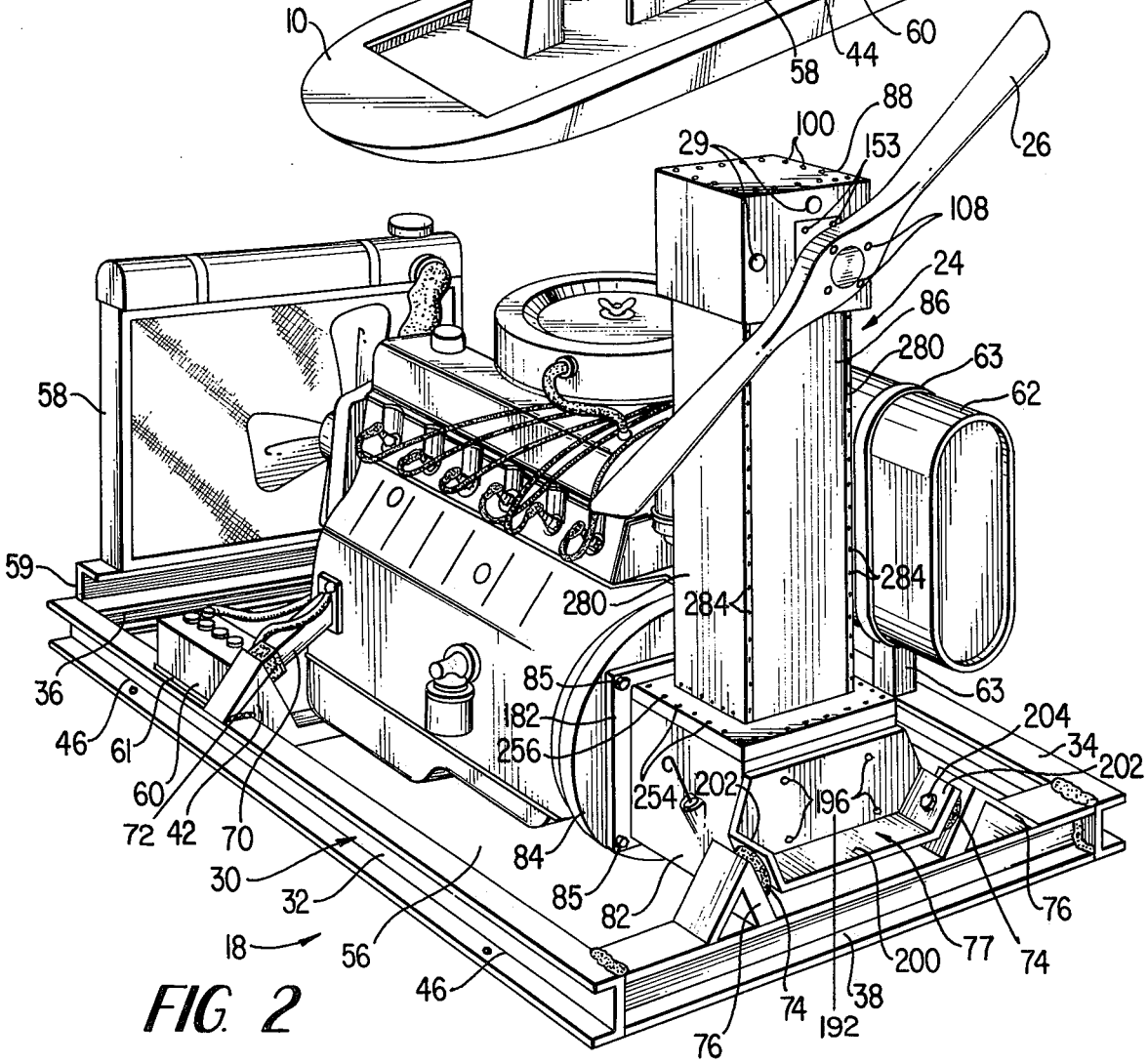
FIG. 2

AIR BOAT

This application is a continuation of my co-pending application Ser. No. 347,865, filed Apr. 4, 1973, and now abandoned.

This invention relates to air boats, and, more particularly, to an integral power unit in an air boat.

BACKGROUND OF THE INVENTION

Contemporary air boats are commonly used in shallow water and swamp land such as the Florida Everglades, for example. These boats draw very little water and are air-propelled by an aircraft type propeller. Typically, these boats are powered by an opposed aircraft engine which is mounted high above the hull to provide adequate clearance for the rotating propeller which is normally axially aligned with the engine crankshaft. Because of the high-mounted engine, the center of gravity of the air boat is rather high. Placement of an engine low in the air boat hull substantially lowers the center of gravity and provides a more stable boat. Numerous patents show air boats with low-mounted engines drivingly connected with elevated propellers independently mounted on the hull or superstructure of a large boat or ship. However, contemporary air boats are relatively small and such independent mounting of the engine and propeller may cause considerable stress in the hull and additionally complicates servicing of the equipment. For example, if the engine requires major servicing this is often done on the boat in typical inboard installations. However, working on an engine in a small boat is not only inconvenient, the labor charges are often substantially higher than comparable charges if the engine is removed from the boat. Removal of a typical inboard engine entails considerable work within the boat in order to disconnect fuel lines, cooling system connections, and the drive train. Once the engine has been removed from the boat and serviced and the engine is returned to the boat these connections must again be made and, if other work is to be done on the fuel tank or parts of the cooling system these components must generally be handled separately from the engine.

As previously mentioned, various patents show air boats having relatively low-mounted engines drivingly connected with independently mounted propellers, and these patents include: U.S. Pat. Nos. 970,532; 998,193; 1,048,337; 1,104,428; 1,459,979; 1,641,937; and 2,341,911. However, as shown in these patents, the propeller and engine are mounted on the boat or vehicle independently of each other.

BRIEF DESCRIPTION OF THE INVENTION

It is a primary object of this invention to provide a new and useful air boat and power unit for an air boat.

Another object is provision of a new and useful air boat in which the propelling mechanism may be installed in and removed from the boat as an integral operative unit.

A further object is provision of a new and useful air boat including an air boat hull, a power unit for propelling the boat, the power unit being operatively assembled for removal from and installation on the hull as an integral unit including a motor, a pylon connected at a lower end portion with the motor, provision at an upper end portion of the pylon for operatively mounting a propeller to propel the boat, and the power unit mounted on the hull with the pylon extending upwardly from the motor to provide a relatively low center of gravity for the boat.

A still further object is provision of a new and useful air boat power unit including a motor and a propeller mounted integrally with the motor, with provision for mounting the power unit on the hull with the propeller above the motor.

Another object is provision of a new and useful air boat power unit including a motor and a propeller supporting pylon connected for unitary handling of the motor and the pylon with the propeller operatively positioned above the motor to provide a low center of gravity when the unit is installed in an air boat.

The invention, in brief, is directed to an air boat and a power unit for an air boat. The power unit may include a base adapted to be mounted on an air boat hull for carrying a motor, and a pylon integral with the motor and carrying a propeller at its upper end, with driving mechanism interconnecting the motor and the propeller. The power unit is adapted to be installed on and removed from the air boat hull as an integral unit. A radiator, fuel tank and other accessories for the motor may be part of the integral power unit.

These and other objects and advantages of the invention will be apparent from the following description and the accompaying drawing.

BRIEF DESCRIPTION OF THE DRAWING

FIG. 1 is a perspective view of an air boat including an integral power unit;

FIG. 2 is an enlarged perspective view of the power unit removed from the boat, with parts removed for clear illustration;

DESCRIPTION OF THE ILLUSTRATED EMBODIMENT

Figure 3:
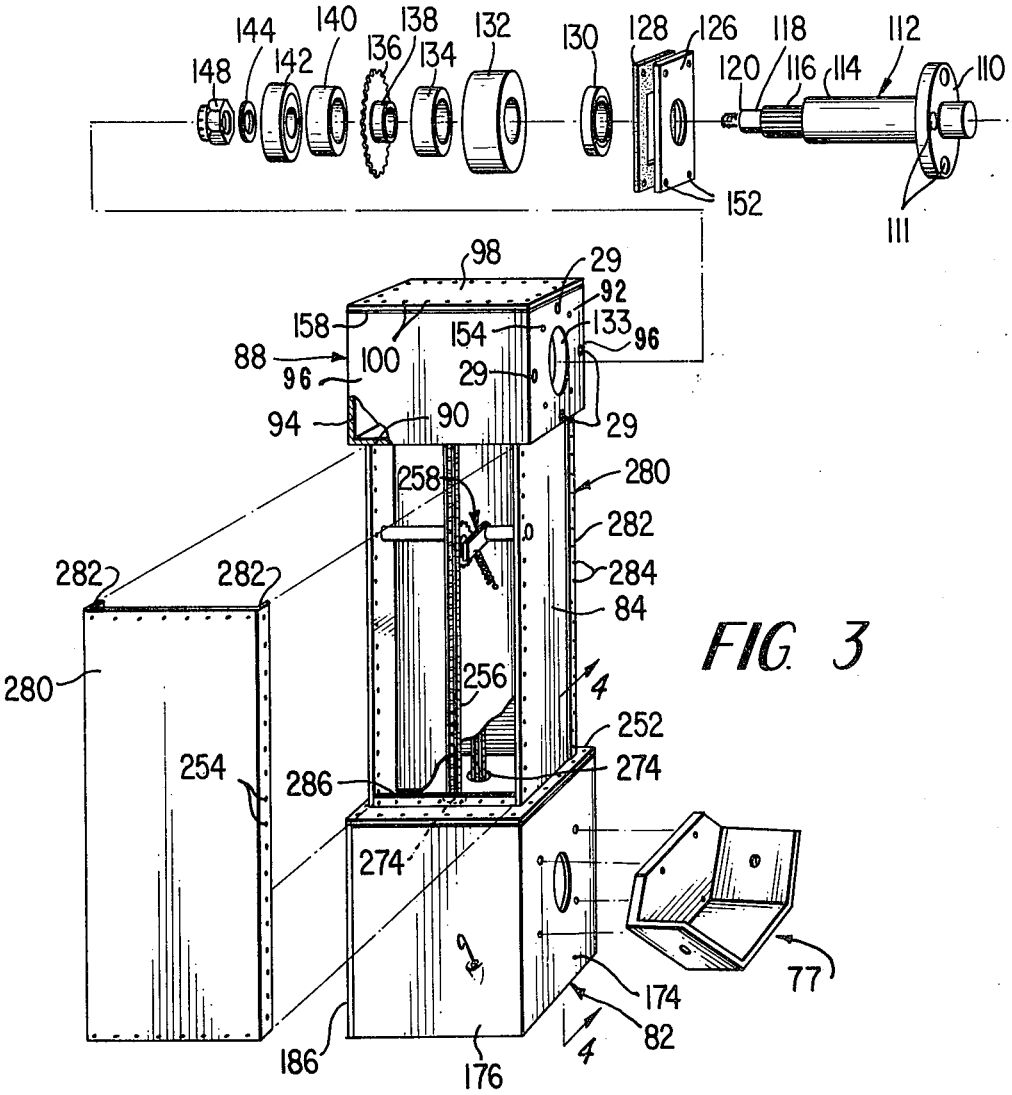
FIG. 3 is an enlarged, fragmentary, schematic, partially exploded view of a propeller mounting pylon shown in FIGS. 1 and 2, with parts broken away for clear illustration.

Referring to FIG. 1 of the drawing, an air boat includes a typical air boat hull 10 including a pilot station 12 having a seat 14 and suitable controls 16 for a power unit 18, and a rudder control 20 for a rudder 22 mounted on the rear of the hull 10. The power unit 18 includes a steel or aluminum pylon 24 carrying an aerodynamic propeller 26 within a protective cage 28 which may be secured to the power unit 18 in any suitable manner as by bolts (not shown) threaded into holes 29 (FIG. 2) of pylon 24.

Turning now to FIG. 2, the propeller cage 28 is removed for clearer illustration. In FIG. 2, the power unit 18 includes a base 30 having metal side channels 32 and 34 interconnected by a forward end channel 36, an aft end channel 38 and an intermediate member 42. The side channels 32 and 34 are secured to the end channels 36 and 38 and the intermediate member 42 in any suitable manner, as by welding. The base 30 more evenly distributes the weight of the power unit on the hull 10, and is releasably connected with the hull by threaded studs extending through holes 46 in lower flange of the adjacent side channel as 32 and secured thereto as by nuts.

A motor 56 and its accessories are mounted on the base 30. The motor 56 is illustrated in the form of an internal combustion, six-cylinder inline Ford automotive engine. Advantages in using a standard automotive engine include use of standard fuels, the usual pollution abatement systems, and availability of standard replacement parts and engine accessories such as a cooling system including a radiator 58, which is mounted on angle 59, secured as by welding to the forward cross member 36, a standard electrical system including a battery 60 which may be mounted in a typical battery case 61 suitably secured to a side channel 32 of the mount 30. Additionally, a suitable fuel tank 62 is secured to the mount 30 by a pair of supports 63 mounted on the side channel 34 of the mount 30 with hold-down straps 64 attached to the tank supports 63.

Standard engine mounts may be utilized and include a pair of front mounts 70 (only one shown) having a resilient pad 72 secured to an inclined face of the intermediate member 42. The illustrated Ford motor 56 has its rear mounts on the standard transmission housing which is not used in the illustrated embodiment. Instead, the usual engine rear mounts 74 are secured in typical manner to wedge-shaped brackets 76 fixed, in any suitable manner as by welding, to the aft cross-channel 38 of the base 30, and to a bracket 77 on a lower portion of the pylon 24 which carries the propeller 26, as will be described later.

With continuing reference to FIG. 2, the pylon 24 includes a lower housing 82 secured to a clutch housing 84 of the motor 56 by means of bolts 85, an I-beam 86 fixed, as by welding, to and extending upwardly from the lower housing 82. At its upper end the I-beam 86 is welded, or otherwise secured, to an upper housing 88 which includes a mount for the propeller 26.

With particular reference to FIG. 3, the upper housing 88 is in the form of a rigid box having a bottom wall 90 suitably fixedly secured to the upper end of the I-beam 86, as by welding, and with side walls integral with the bottom wall 90 and including a rear wall 92, a front wall 94 and opposed side walls 96. A top wall 98 is removably secured to upper edges of the side walls in any suitable manner as by bolts 100 extending through holes in the top wall 98 and received in threaded sockets opening through the upper edges of the side walls.

The propeller 26 (FIGS. 1 and 2) may be any suitable aircraft or other air type propeller and is typically mounted, as by bolts 108 (FIG. 2) on a propeller flange 110 having threaded sockets for the bolts 108, and formed integrally with a propeller drive shaft 112. Extending from the propeller attaching flange 110, the shaft 112 has a smooth cylindrical portion 114 followed by a reduced splined portion 116 and then a further reduced smooth cylindrical portion 118 and a still further reduced threaded portion 120.

Before mounting the drive shaft 112 in the housing 88, a rigid rectangular retainer 126 is slipped over the free end of the shaft 112 and adjacent the propeller flange 110, followed by a rectangular sealing gasket 128. A spacer 130 is next telescoped onto the cylindrical portion 114 of the shaft 112 and is followed by a thrust bearing 132 for receipt in a seat 133 in the housing 88, and then a second spacer 134. With these parts positioned on the propeller shaft 112, the threaded end 120 of the shaft is inserted through a bearing mount 133 in the wall 92 of the housing 88. A chain sprocket 136 has a spline hub 138 and is positioned within the housing 88 and telescoped onto the spline portion 116 of the propeller drive shaft 112. Thereafter, a spacer 140 is telescoped onto the spline portion 116 followed by a bearing 142 which is telescoped onto cylindrical portion 118 of the shaft and against the spacer 140. Next, a spacer 144 is telescoped onto the shaft and against the inner race of the bearing 142 and these components are held in assembly by a nut 148 threaded onto the threaded end 120 of the shaft 112 and locked in position in any suitable manner as by a cotter key (not shown). The bearing 142 is received in a suitable seat (not shown) in the front wall 94 of the housing 88 and the thrust bearing 132 is seated in its seat 133. The drive shaft assembly is held in position by the retainer 126 which has suitable holes 152 for receiving bolts 153 (FIG. 2) threadedly received in sockets 154 in the wall 92 of the housing 88. A sealing cap 156 (FIG. 1) is suitably secured to the front wall 94 to cover the nut 148. Next a rectangular gasket 158 is positioned on the upper edge portions of the side walls and the cover 98 is secured to the side walls by the bolts 100, as previously described.

Figure 4:
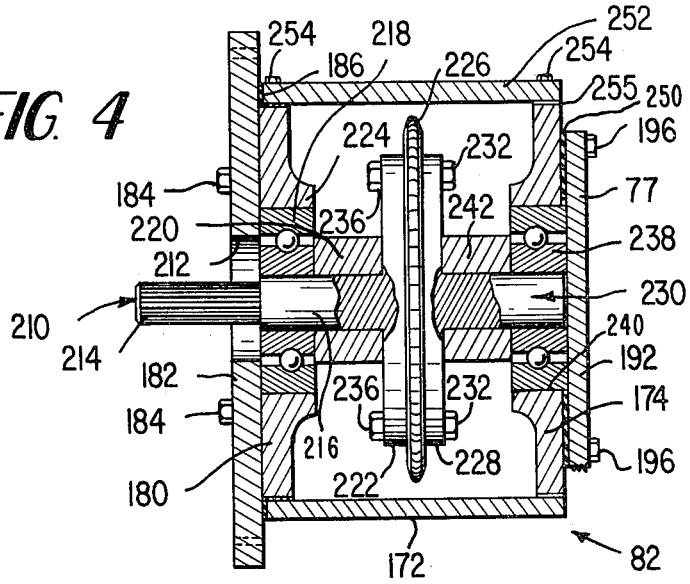
FIG. 4 is a fragmentary, schematic, sectional view of a lower portion of the pylon, and taken generally along the line 4—4 in FIG. 3.

With continuing reference to FIGS. 3 and 4, the lower housing 82 of the pylon 24 includes a bottom wall 172, a rear wall 174, side walls 176 (only one visible), and a front wall 180. The walls 174, 176 and 180 are fixedly secured to each other and to the bottom wall 172 in any suitable manner as by welding. An adapter plate 182 (FIGS. 2 and 4) has holes for receiving bolts 184 (FIG. 4) threaded into sockets in the front wall 180 of the housing 82. A gasket 186 is provided between the adapter plate 182 and the wall 180. Other holes in the adapter plate 182 are provided for receiving the bolts 85 (FIG. 2) mating with conventional threaded sockets in the clutch housing 84 (FIG. 2) for fixedly securing the pylon 24 to the motor 56. The bracket 77 (FIGS. 2, 3 and 4) has an upright flange 192 with holes for receiving bolts 196 threaded into the rear wall 174 of the housing 82. Secured to the flange 192, in any suitable manner as by welding, is a horizontal flange 200 and a pair of oppositely inclined flanges 202, these flanges being suitably fixed to each other as by welding. Bolts 204 extend through the inclined members 202 and through the cushioning pad 74 and are threaded into holes in the adjacent inclined members 76.

With reference to FIG. 4, a clutch connection shaft 210 extends through a hole 212 in the adapter plate 182 and has a spline portion 124 mated with a complementary spline portion (not shown) of the clutch. Rearwardly of the spline portion 214 the shaft 210 has an enlarged cylindrical portion 216 receiving the inner race of a ball bearing 218 and a spacer 220 which abutts the inner race of the bearing and a cylindrical flange 222 on the rear end of the shaft 210. The outer race of the bearing 218 has its outer race received in a bearing seat 224 in the side wall 180 of the housing. A chain sprocket 226 is clamped between flange 222 on the shaft 210 and a flange 228 of a rear shaft 230. Clamping is accomplished by bolts 232 extending through aligned holes in the flanges 222 and 228 and the sprocket 226, and nuts 236 on the bolts 232. A thrust bearing 238 is seated on the rear shaft 230 and in a bearing seat 240 in the wall 174 of the housing, with a spacer 242 on the shaft 230 between the flange 228 and the inner race of the bearing 238. The upright flange 192 covers the bearing 238 and is seated against the outer race of the bearing 238 with a gasket 250 between the flange 192 and the wall 174. A top wall 252 of the lower housing is suitably secured, as by welding, to the lower end of the I-beam 86 and is secured to the upper edges of the side walls 174–180 of the housing by bolt 254 extending through holes in the top wall 252 and threaded into threaded sockets opening through the upper edge portions of these walls. A gasket 255 is between these edge portions and the top wall.

A driving connection is provided between the motor 56 and the propeller 26 and includes a chain drive. The chain drive includes the sprocket 226 (FIG. 4) and the sprocket 136 (FIG. 3) which receives a continuous drive chain 256 (FIG. 2) with opposite runs of the drive chain passing through opposite channels of the I-beam 86. A spring-operated tension device 258 (FIG. 3) is preferably mounted in one of the channels of the I-beam 86 for retaining the chain 256 taut. The drive chain 256 extends through holes 274 in the top wall 252 of the housing 82 and through holes (not shown) in the bottom wall 90 of the upper housing 88. By varying the sprocket sizes, any desired drive ratio may be obtained, such as 2,000 rpm propeller speed at 4,400 rpm engine speed.

If desired, a suitable belt drive may be provided in lieu of the chain drive. The pylon 24 may be easily adapted for use on various engines by replacing the adapter plate 182 and the clutch shaft 210 with parts to fit another clutch.

While the engine accessories such as the battery 56, radiator 58, and gas tank 60, may be mounted on other portions of the hull 10, if desired, it is preferable that they be mounted on the base 30 so that the basic power unit 18 including the engine 56 and the pylon 24 may be removed as an integral unit from the hull by simply releasing the mounts 44 and disconnecting the connections from the controls 16 (FIG. 1), as a linkage 278 (FIG. 1) to a carburator, and then hoisting the power unit out of the boat.

Suitable covers 280 each have opposed flanges 282 with gaskets (not shown) which receive bolts 284 threaded into threaded holes in edge portions of the I-beam flanges and in retainers 286 to prevent lubricant carried by the chain from the lower housing to the upper housing from splattering.

While this invention has been described with reference to a particular embodiment in a particular environment, various changes may be apparent to one skilled in the art and the invention is therefore not to be limited to such embodiment or environement, except as set forth in the appended claims.

What is claimed is:

1. An air boat comprising, an air boat hull, a hull propelling assembly including a motor and an aerodynamic propeller, the propelling assembly further including means mounting the propeller above the motor and operatively supporting the propeller on the motor for propelling the hull, said means being a pylon having an upper portion with a propeller mount operatively receiving the propeller, and said pylon having a lower portion with substantially the entire vertical support for said pylon being at said lower portion of said pylon, and the mounting means further including means defining a vertical load bearing connection between said lower portion and said motor with said motor supporting at least a substantial portion of the weight of said pylon and in which said lower portion and said motor are secured, one on the other, and the propelling assembly further including means drivingly connecting the propeller mount and the motor for operating the propeller, responsive to operation of the motor, to propell the air boat hull, and means mounting the propelling assembly on the hull with the propeller mount above the motor.

2. An air boat as set forth in claim 1 in which the motor is an internal combustion engine having a typical engine block, and said pylon is secured to said block and positions the connecting means in driven engagement with the engine.

3. An air boat as set forth in claim 1 in which the last said mounting means releasably mounts said assembly for unitary installation in and removal from the air boat.

4. An air boat as set forth in claim 3 in which the last said mounting means comprises a base and said assembly is mounted on said base, and the last said mounting means further includes means releasably mounting said base on the air boat.

5. An air boat as set forth in claim 4 in which said motor is an internal combustion engine, a cooling system including an air cooled radiator operatively connected with said engine, and said radiator is mounted on said base for handling therewith.

6. An air boat as set forth in claim 5 in which said engine has a typical engine block, said pylon is secured to said block and positions the connecting means in driven engagement with the engine, said assembly includes a fuel system having a fuel tank operatively connected with said motor; and said tank is mounted on said base for unitary handling therewith.

7. An air boat power unit comprising, a motor and a propeller mount for an aerodynamic propeller, means mounting the propeller mount above the motor and operatively supporting the propeller mount on the motor, said means being a pylon having an upper portion including said propeller mount, and said pylon having a lower portion with substantially the entire vertical support for said pylon being at said lower portion, and the mounting means further including means defining a vertical load bearing connection between said lower portion and said motor with said motor supporting at least a substantial portion of the weight of said pylon and in which said lower portion and said motor are secured, one on the other, and means drivingly connecting the propeller mount and the motor for operating a propeller on the propeller mount, responsive to operation of the motor, to propel an air boat.

8. An air boat power unit as set forth in claim 7 in which the motor is an internal combustion engine having a typical engine block, and said pylon is secured to said block and positions the connecting means in driven engagement with the engine.

9. An air boat power unit as set forth in claim 8 including a base for mounting on an air boat, and said motor and said pylon are mounted on said base.

10. An air boat power unit as set forth in claim 9 in which said motor is an internal combustion engine, a cooling system including an air cooled radiator operatively connected with said engine, and said radiator is mounted on said base for unitary handling therewith.

11. An air boat power unit as set forth in claim 10 in which said engine has a typical engine block, said pylon is secured to said block and positions the connecting means in driven engagement with the engine, a fuel system including a fuel tank operatively connected with said motor, and said tank is mounted on said base for unitary handling therewith.

12. An air boat comprising, an air boat hull, and a hull propelling assembly including: a motor, an aerodynamic propeller on a propeller mount, a pylon having an upper portion supporting said propeller mount with the propeller above the motor and operatively supporting the propeller on the motor for propelling the hull, means on a lower portion of said pylon supporting substantially the entire weight of said pylon and said propeller mount including a vertical load bearing connection between said lower portion of said pylon and said motor supporting at least a substantial portion of said weight and securing said lower portion of said pylon and said motor, one on the other, and drive means operatively connected with said motor through said connection and drivingly connecting the propeller mount and the motor for operating the propeller, responsive to operation of the motor, to propell the air boat hull; and means mounting said propelling assembly on the hull with the propeller mount above the motor.

13. An air boat as set forth in claim 12 in which said drive means extends through said pylon.

14. An air boat as set forth in claim 12 in which said supporting means supports said pylon with the pylon substantially free standing.

15. An air boat as set forth in claim 12 in which said supporting means supports a rear portion of said pylon on said mounting means and said connection is at a front portion of said pylon.

16. An air boat as set forth in claim 12 in which the mounting means includes a base and means attaching the base to the hull, and said motor and said pylon are releasably mounted on said base, and said supporting means supports a rear portion of said pylon on said base and said connection is at a front portion of said pylon.

17. An air boat as set forth in claim 16 in which said connection retains said driving means in driven engagement with said motor.

18. An air boat as set forth in claim 17 in which said drive means extends through said pylon, and said supporting means supports said pylon with the pylon substantially free standing.

19. An air boat as set forth in claim 18 in which said motor is an internal combustion engine, a cooling system including an air cooled radiator operatively connected with said engine, and said radiator is mounted on said base for handling therewith, and a fuel system having a fuel tank operatively connected with said engine; and said tank is mounted on said base for unitary handling therewith.

20. An air boat power unit comprising, a motor, a propeller mount for an aerodynamic propeller, a pylon having an upper portion supporting said propeller mount above the motor and operatively supporting said propeller mount on the motor, means on a lower portion of said pylon supporting substantially the entire weight of said pylon and said propeller mount and including a vertical load bearing connection between said lower portion of said pylon and said motor supporting at least a substantial portion of said weight and securing said lower portion of said pylon and said motor, one on the other, and drive means operatively connected through said connection with said motor and drivingly connecting the propeller mount and the motor for operating a propeller on the propeller mount.

21. A unit as set forth in claim 20 in which said drive means extends through said pylon.

22. A unit as set forth in claim 20 in which said supporting means supports said pylon with the pylon substantially free standing.

23. A unit as set forth in claim 20 in which the supporting means further includes means on a rear portion of said pylon for supporting said pylon and said connection is at a front portion of said pylon.

24. A unit as set forth in claim 20 including a base, means for attaching the base to an air boat hull, said motor and said pylon are releasably mounted on said base, said drive means extends through said pylon and said supporting means supports said pylon with the pylon substantially free standing and supports a rear portion of said pylon on said base and said connection is at a front portion of said pylon.

25. A unit as set forth in claim 24 in which the motor is an internal combustion engine having a typical engine block, and said connection secures said pylon to said block to retain said driving means in driven engagement with the engine.

26. A unit as set forth in claim 25 including a cooling system having an air cooled radiator operatively connected with said engine, and said radiator is mounted on said base for handling therewith, and a fuel system having a fuel tank operatively connected with said engine; and said tank is mounted on said base for unitary handling therewith.

27. A unit as set forth in claim 20 in which said vertical load bearing connection includes means releasably securing said pylon and said motor to each other, the last said means being interchangeable with similar means for operatively interconnecting said pylon and various different motors.

28. A unit as set forth in claim 27 in which the last said means is a plate releasably secured to said pylon and independently releasably secured to said motor.

29. A unit as set forth in claim 20 in which said drive means includes means interchangeable with similar means for drivingly connecting said propeller mount with various different motors.

30. A unit as set forth in claim 29 in which said drive means extends through said pylon, and the interchangeable means is a shaft.

31. A unit as set forth in claim 30 in which said vertical load bearing connection includes means releasably securing said pylon and said motor to each other, the last means being a plate releasably positioned between said pylon and said motor and interchangeable with similar plates for operatively interconnecting said pylon and various different motors.

32. A unit as set forth in claim 31 including a base, means for attaching the base to an air boat hull, said motor and said pylon are releasably mounted on said base, said supporting means supports said pylon with the pylon substantially free standing and supports a rear portion of said pylon on said base and said connection is at a front portion of said pylon, said motor is an internal combustion engine, a cooling system including an air cooled radiator operatively connected with said engine, and said radiator is mounted on said base for handling therewith, and a fuel system having a fuel tank operatively connected with said engine, and said tank is mounted on said base for unitary handling therewith.

* * * * *